US007063601B1

(12) United States Patent
Kim

(10) Patent No.: US 7,063,601 B1
(45) Date of Patent: Jun. 20, 2006

(54) INTERNAL MAGNETIC-FORCE POLISHING SYSTEM

(75) Inventor: Jeong-Du Kim, 101-603 Park palace, 95 Naesu-dong Jongro-gu, Seoul (KR) 110-070

(73) Assignees: Sejong University Industry-Academy Cooperation Foundation, Seoul (KR), part interest; Jeong-Du Kim, Seoul (KR), part interest ( * ) Notice: Subject to any disclaimer, the term of this patent is extended or adjusted under 35 U.S.C. 154(b) by 0 days.

(21) Appl. No.: 11/039,117

(22) Filed: Jan. 19, 2005

(51) Int. Cl.
*B24B 1/00* (2006.01)
*C25F 3/16* (2006.01)

(52) U.S. Cl. ..... 451/113; 451/285; 205/652; 205/672; 205/686; 204/224 M

(58) Field of Classification Search ..... 451/113, 451/285, 286–290; 205/652, 672, 665, 640, 205/654, 686; 204/272, 217
See application file for complete search history.

(56) References Cited

U.S. PATENT DOCUMENTS 4,072,598 A * 2/1978 Damgaard ..... 204/274
5,820,744 A * 10/1998 Edwards et al. ..... 205/640
6,203,689 B1 * 3/2001 Kim et al. ..... 205/652
6,863,797 B1 * 3/2005 Sun et al. ..... 205/684
2003/0132118 A1 * 7/2003 Kovarsky ..... 205/89
2005/0233578 A1 * 10/2005 Jia et al. ..... 438/633

FOREIGN PATENT DOCUMENTS

KR 10-0236918 10/1999

* cited by examiner

*Primary Examiner*—Lee D. Wilson
*Assistant Examiner*—Anthony Ojini
(74) *Attorney, Agent, or Firm*—Jordan and Hamburg, LLP

(57) ABSTRACT

An internal magnetic-force polishing system is disclosed for finishing a interior metal surface of a material. The system comprises a magnetic electrolysis-polishing which is adapted for finishing the interior metal surface of the material. A cathode terminal is provided for contacting pre-finished material and a transfer unit is also provided for transferring material from the cathode terminal to the magnetic electrolysis-polishing unit. The system has an electrolyte feeding unit which stores electrolytes and supplies the electrolyte to the magnetic electrolysis-polishing unit. A control unit is provided for controlling the transfer unit, the magnetic electrolysis-polishing unit and the electrolyte feeding unit.

4 Claims, 3 Drawing Sheets

INTERNAL MAGNETIC-FORCE POLISHING SYSTEM

BACKGROUND OF THE INVENTION

The present invention relates to an internal magnetic-force polishing system for polishing inside surfaces of parts of products requiring high precision and extreme purity.

There currently are two existing types of polishing system: the mechanical polishing system, which polishes surfaces by means of mechanical force; and the electrolysis polishing system for polishing surfaces by electrochemical means.

The mechanical polishing system finishes the surface stepwise by using fine abrasives coupled with abrasive solutions. Since this method requires the abrasives to directly contact the target surface, it is difficult to employ the method on small parts and intricate shapes. And because it leaves scratches, residual stresses, and impurities on the surface, it is unsuitable for polishing parts requiring extreme purity, such as food or medical parts.

The electrolysis polishing system, on the other hand, finishes the surface by polarizing the target work and electrolyzes it with high-density current in a short period of time, thereby removing dirt and dissolving the thickened portion of the work's surface. Since this method can do the polishing job without direct contact, it is relatively free from the problems common to the mechanical polishing system.

However, with the electrolysis system, the degree of polishing efficiency is directly proportional to the number of electrolyzed ions, where the electrolyzed ions move in a straight line motion and efficient finishing is less anticipated. Because of this limitation, electrolysis polishing is useful only in removing small unevenness on the surface and not relatively large ones.

The present invention has been devised in order to solve the above-mentioned problems with the two existing polishing systems. The internal magnetic-force polishing system can finish the inside surface of food or hygienic parts without compromising the requisite level of hygienic performance, and increase the durability of the parts by eliminating corrosion or cracks developed due to residual stress, thereby maintaining the extreme purity of the product.

DETAILED DESCRIPTION OF THE INVENTION

Figure 1:
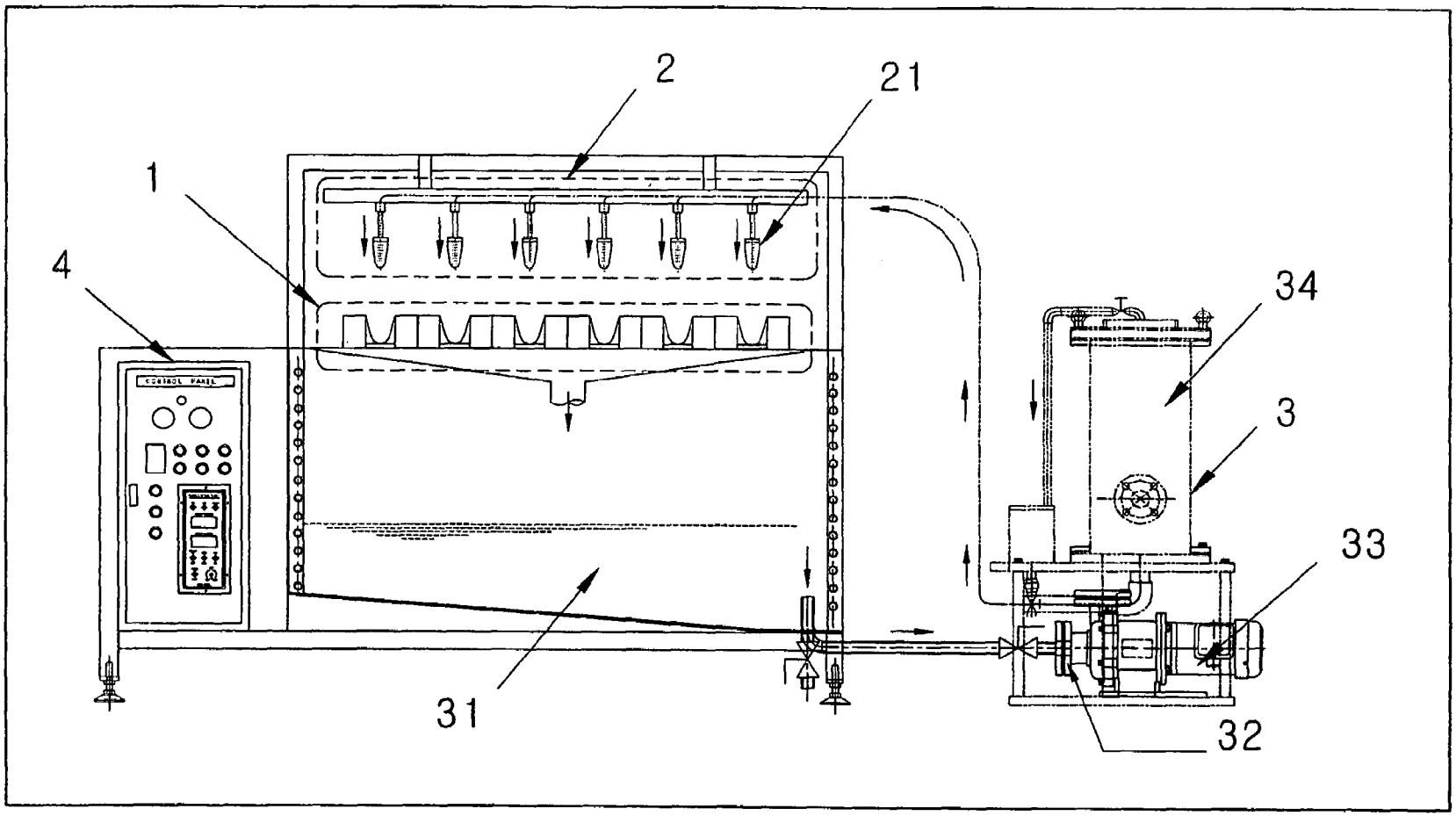
FIG. 1 is the schematic drawing of the configuration of the internal magnetic-force polishing system.

The following elements are presented in the drawings:

1: Transfer Unit
2: Magnetic Electrolysis-Polishing Unit
3: Electrolyte-Feeding Unit
4: Control Unit
11: Air Cylinder
21: Internal Magnetic-Force Polishing Unit

22: Nozzle
23: Magnet
24: Bolt
31: Electrobath
32: Filter 1
33: Acid-Resistant Pump
34: Filter 2

Figure 2:
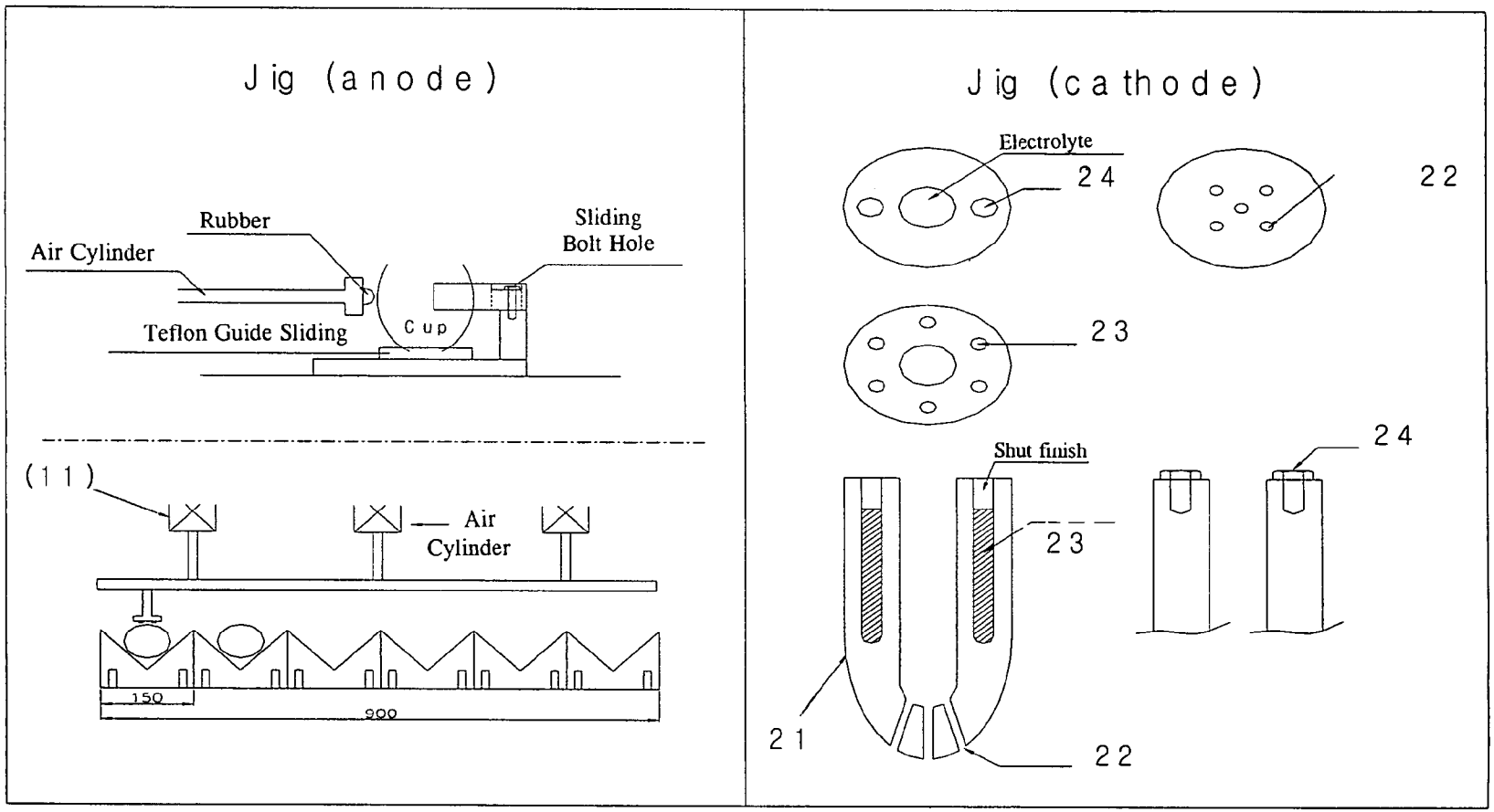
FIG. 2 is the detailed drawing describing the major components of the internal magnetic-force polishing system shown in FIG. 1.

The following is an example application of the present invention. The same component will have same reference number as possible though they are shown on the different drawings. FIG. 1 is a schematic drawing showing the operational relations of the internal magnetic-force polishing system. FIG. 2 shows in detail the major components of the internal magnetic-force polishing system.

The invention consists of a transfer unit (1) which transmits a metal member in contact with a cathode (–) terminal, a magnetic electrolysis-polishing unit (2) which polishes target works by magnetic electrolysis, an electrolyte-feeding unit (3) which stores and feeds electrolytes used in the electrolytic polishing and a control unit (4) which controls the operation.

The transfer unit (1) enables the vertical transfer of the metal members in contact with the cathode (–) terminal through the operation of an air cylinder (11) and can fix the target works in contact with an anode (+) terminal.

The magnetic electrolysis-polishing unit (2) performs magnetic electrolysis polishing for the inside surface of the works when an internal magnetic-force polishing unit (21) is inserted into the target works and when the electrolyte and current are supplied.

The electrolyte is supplied from an electrobath (31) to an acid-resistant pump (33) through a filter 1 (32), and from the acid-resistant pump (33) to the internal magnetic-force polishing unit (21) through a filter 2 (34), as shown in FIG. 1.

As can be seen in FIG. 2, the electrolyte is supplied to the internal magnetic-force polishing unit (21) through the center and reaches the target works and the unit through the nozzle (22) at the bottom of the unit (21).

Also, with a magnet (23) inserted in the unit (21), it is possible to perform magnetic electrolytic polishing without needing a separate magnet.

Due to the influence of the Lorentz power induced from the magnetic power, the electrolyzed ions behave in a circular motion and show more complicated spiral motion as close to the surface of the works as possible, resulting in a number of improvements, such as an increased number of ions actually participating in the electrolytic polishing, and a more efficient finishing by changing the incidence angle of the metal ions arriving on the surface of the works. As a result, the process of electrolytic polishing becomes more effective in removing surface roughness compared to other conventional electrolytic polishing methods.

The control unit controls the air cylinder (11) of the transfer unit (1) to enable the vertical transfer of the metal members. The control unit also controls the power supply of the acid-resistant pump (33). It also controls the magnetic electrolysis-polishing unit (2) to supply the electrolyte and power to the internal magnetic-force polishing unit (21). The control unit also detects and indicates the current and voltage of the power supplied on the display panel.

Figure 3:
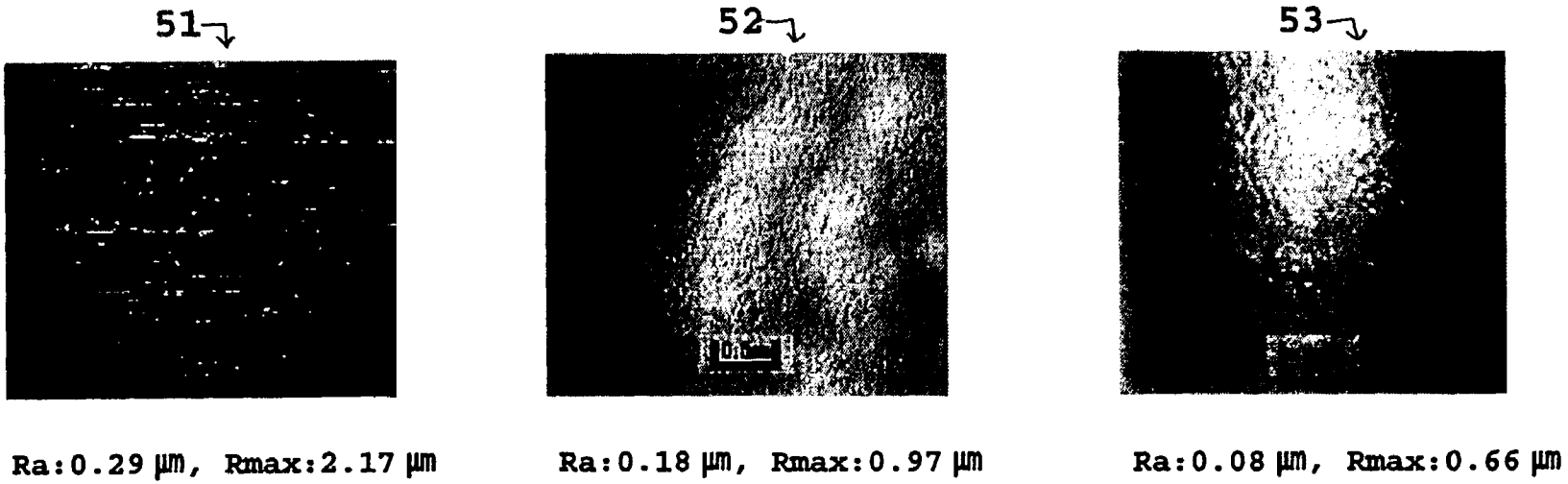
FIG. 3 is the comparison of surfaces finished by the existing mechanical polishing method, by the existing conventional electrolysis-polishing method, and by this proposed system—the internal magnetic-force polishing system.

FIG. 3 is a comparison of three surfaces finished using the existing mechanical polishing method, the existing conventional electrolysis-polishing method, and the internal magnetic-force polishing system.

As shown in FIG. 3, scratches remained on the surface (50) when finished by the existing mechanical polishing method, which causes degradation of corrosion-resistance performance and decreases the purity of the final product.

With the conventional electrolysis-polishing method, no scratch remained on the surface (51) but a lower quality in gloss and surface roughness was shown.

The internal magnetic-force polishing system can finish the inside surface of food or hygienic parts without compromising the requisite level of hygienic performance, and increase the durability of the parts by eliminating corrosion or cracks developed due to residual stress, thereby maintaining the extreme purity of the product.

But with the internal magnetic-force polishing system, the inside surface (52) of the food or hygienic parts was finished in a clean way, without compromising hygienic performance, it durability was increased by eliminating corrosion or cracks developed due to residual stress, thereby could produce the product with extreme purity.

Accordingly, the internal magnetic-force polishing system of the present invention circumvents problems inherent in the two existing types of polishing system the mechanical type and the electrolytic type. The problems with the mechanical polishing system include the inability to reach small spaces and intricate shapes, as well as leaving scratches, residual stresses, and impurities on the surface. Therefore, it is unsuitable for polishing parts requiring extreme purity, such as food or medical parts.

The electrolysis polishing system, on the other hand, removes the fine scratches developed on the surface by electrochemical reaction without direct contact, thereby relatively free from the problems common to the mechanical polishing system. However, the conventional electrolytic type is efficient only with minor surface unevenness and not with relatively larger ones since the electrolyzed ions moves in straight line motion, the degree of polishing efficiency is proportional to the number of electrolyzed ions, and efficient finishing is less anticipated.

Therefore, this invention has been devised in order to solve the above-mentioned problems. The internal magnetic-force polishing system aims to hurdle the limitations of the mechanical and the conventional electrolytic polishing systems to finish the inside surface of food or hygienic parts cleanly, thereby maintaining extreme purity of the product and increasing the durability of the parts without compromising the hygience and by preventing corrosion or cracks developed due to residual stress.

I claim:

1. An internal magnetic-force polishing system for finishing a interior metal surface of a material, said system comprising:

a magnetic electrolysis-polishing unit, said magnetic electrolysis-polishing unit being adapted for finishing the interior metal surface of the material;

a cathode terminal, said cathode terminal being adapted for contacting pre-finished material;

a transfer unit, said transfer unit being adapted for transferring material contacting said cathode terminal to said magnetic electrolysis-polishing unit;

an electrolyte feeding unit, said electrolyte feeding unit being adapted for storing electrolyte and suppling the electrolyte to said magnetic electrolysis-polishing unit; and a control unit, said control unit being adapted for controlling said transfer unit, said magnetic electrolysis-polishing unit and said electrolyte feeding unit.

2. The system of claim 1, wherein said transfer unit comprises an air cylinder, said air cylinder being adapted for providing vertical transfer of the material from said cathode terminal, said transfer unit being adapted for positioning said materials against said anode terminal.

3. The system of claim 1, wherein said the magnetic electrolysis polishing unit comprises an internal magnetic-force polishing unit, said internal magnetic-force polishing unit being adapted for inserting into said material and receiving current so that said magnetic electrolysis polishing unit finishes the inside surface of the material.

4. The system of claim 1, wherein the electrolyte-feed unit comprises:

an acid-resistant pump;

an electrobath;

a first filter being adapted for purifying the electrolyte received from said electrobath and transferring the electrolyte to said acid-resistant pump;

said acid-resistant pump being adapted for further transferring the electrolyte to said magnetic electrolysis-polishing unit; and a second filter for purifying the electrolyte received from said acid-resistant pump.

* * * * *